US007742005B2

(12) United States Patent
Villarroel et al.

(10) Patent No.: US 7,742,005 B2
(45) Date of Patent: Jun. 22, 2010

(54) MULTI-BAND STRIP ANTENNA

(75) Inventors: Wladimiro Villarroel, Ypsilanti, MI (US); Nuttawit Surittikul, Bangkok (TH); Qian Li, Ann Arbor, MI (US); Kwan-ho Lee, Ann Arbor, MI (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 173 days.

(21) Appl. No.: 11/965,089

(22) Filed: Dec. 27, 2007

(65) Prior Publication Data

US 2008/0158074 A1 Jul. 3, 2008

Related U.S. Application Data

(60) Provisional application No. 60/877,455, filed on Dec. 28, 2006.

(51) Int. Cl.
*H01Q 1/34* (2006.01)

(52) U.S. Cl. ..... 343/713

(58) Field of Classification Search ..... 343/713, 343/700 MS, 765–767, 770, 702
See application file for complete search history.

(56) References Cited

U.S. PATENT DOCUMENTS

| | | | |
|---|---|---|---|
| 4,072,953 | A | 2/1978 | Comastri et al. |
| 4,072,954 | A | 2/1978 | Comastri et al. |
| 4,090,202 | A | 5/1978 | Comastri et al. |
| 4,527,164 | A | 7/1985 | Cestaro et al. |
| 4,823,142 | A | 4/1989 | Ohe et al. |
| 5,418,543 | A | 5/1995 | Bolton |
| 5,646,637 | A | 7/1997 | Miller |
| 5,650,791 | A | 7/1997 | Talty |
| 5,659,324 | A | 8/1997 | Taniguchi et al. |
| 5,663,737 | A | 9/1997 | Kakizawa |
| 5,675,347 | A | 10/1997 | Terashima et al. |
| 5,825,335 | A | 10/1998 | Arai et al. |
| 5,926,141 | A | 7/1999 | Lindenmeier et al. |
| 6,054,961 | A | 4/2000 | Gong et al. |
| 6,097,345 | A | 8/2000 | Walton |
| 6,140,969 | A | 10/2000 | Lindenmeier et al. |
| 6,150,985 | A | 11/2000 | Pritchard |
| 6,172,651 | B1 | 1/2001 | Du |
| 6,184,836 | B1 | 2/2001 | Ali |
| 6,307,511 | B1 | 10/2001 | Ying et al. |
| 6,362,784 | B1 | 3/2002 | Kane et al. |
| 6,369,768 | B1 | 4/2002 | Fusinski |
| 6,480,162 | B2 | 11/2002 | Sabet et al. |
| 6,486,840 | B1 | 11/2002 | Buren |
| 6,608,597 | B1 | 8/2003 | Hadzoglou et al. |
| 6,664,932 | B2 | 12/2003 | Sabet et al. |
| 6,693,597 | B2 | 2/2004 | Walton et al. |

(Continued)

FOREIGN PATENT DOCUMENTS

| | | | |
|---|---|---|---|
| EP | 1732160 | A1 | 12/2006 |

*Primary Examiner*—Huedung Mancuso
(74) *Attorney, Agent, or Firm*—Howard & Howard Attorneys PLLC

(57) ABSTRACT

A multi-band antenna includes a non-conductive pane, a ground plane disposed on the non-conductive pane, and a radiating strip for operating in a plurality of frequency bands. The radiating strip includes an elongated portion and a meander line portion extending away from an end of the elongated portion. The radiating strip also includes a pair of tuning stubs extending from the elongated portion.

14 Claims, 5 Drawing Sheets

U.S. PATENT DOCUMENTS

| | | | | |
|---|---|---|---|---|
| 6,828,939 | B2 | 12/2004 | Li | |
| 6,917,335 | B2 | 7/2005 | Kadambi et al. | |
| 6,946,994 | B2 | 9/2005 | Imaizumi et al. | |
| 7,164,387 | B2 | 1/2007 | Sievenpiper | |
| 7,230,571 | B2 | 7/2007 | Gaucher et al. | |
| 7,242,357 | B2 * | 7/2007 | Fujii et al. | 343/713 |
| 7,242,358 | B2 | 7/2007 | Noh | |
| 7,265,726 | B2 | 9/2007 | Kenoun et al. | |
| 7,327,317 | B2 * | 2/2008 | Heiniger | 343/700 MS |
| 7,446,714 | B2 * | 11/2008 | Biddulph | 343/702 |
| 2003/0043081 | A1 * | 3/2003 | Achim | 343/702 |

* cited by examiner

MULTI-BAND STRIP ANTENNA

CROSS REFERENCE TO RELATED APPLICATION

This application claims the benefit of U.S. Provisional Application No. 60/877,455, filed Dec. 28, 2006.

BACKGROUND OF THE INVENTION

1. Field of the Invention

The subject invention relates to a multi-band antenna, specifically to a conductive strip antenna, disposable on a window for transmitting and receiving RF signals.

2. Description of the Related Art

Conductive strip antennas that are disposable on windows of vehicles are well known to those skilled in the art. These antennas are often used to receive broadcasts from radio stations in the AM and FM broadcast bands and are commonly used in vehicles. The primary advantage of such antennas is the removal of the vertical rod antennas that typically extend from body panels of vehicles. This provides improved vehicle aesthetics as well as less wind resistance for the vehicle.

Development of cellular communications networks, often referred to as mobile communications networks, cellular phone networks, or mobile telephone networks, has progressed at breakneck speeds over the last few decades. As such, RF coverage of these networks is nearly ubiquitous in populated areas of the planet. Manufacturers continue to integrate devices that utilize these networks into vehicles for both voice and data communications. As with AM/FM antennas, these cellular antennas are frequently rods or posts that extend from body panels.

Development of these cellular communication networks have been done in a piecemeal fashion, such that the frequency bands that they utilize are spread throughout the electromagnetic spectrum. Often it is desirable to have an antenna that can operate in several of these frequency bands to accommodate a wide variety of networks.

As stated above, the prior art discloses antennas that are disposable on windows of vehicles. However, these antennas often do not operate on multiple frequency bands. Furthermore, when these antennas do operate on multiple frequency bands, they often define a large surface area that may either obstruct the view of a driver of a vehicle and/or are not aesthetically pleasing.

SUMMARY OF THE INVENTION AND ADVANTAGES

A multi-band antenna includes a ground plane formed of conductive material. A radiating strip formed of conductive material is disposed generally co-planar with the ground plane. The radiating strip includes an elongated portion having a proximal end adjacent the ground plane and a distal end terminating in a meander line portion opposite the proximal end of the elongated portion. A first tuning stub extends from a first point on the elongated portion between the proximal end and the distal end. A second tuning stub extends from a second point on the elongated portion between the proximal end and the distal end.

The antenna of the subject invention provides excellent performance characteristics for transmitting or receiving RF signals over multiple frequency bands. Specifically, the meander line portion provides the antenna with capabilities to operate on a second frequency band. Furthermore, the meander line portion allows the antenna to have smaller dimensions than an alternative antenna implemented with a straight line. The tuning stubs help the antenna excite RF signals having a vertical polarization. Furthermore, the tuning stubs are tunable to adjust the resonant frequencies of the antenna. The resulting antenna maintains a compact footprint which does not obstruct the vision of a driver of the vehicle and is aesthetically pleasing.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, an antenna for operating in multiple frequency bands is shown at 10.

Figure 1:
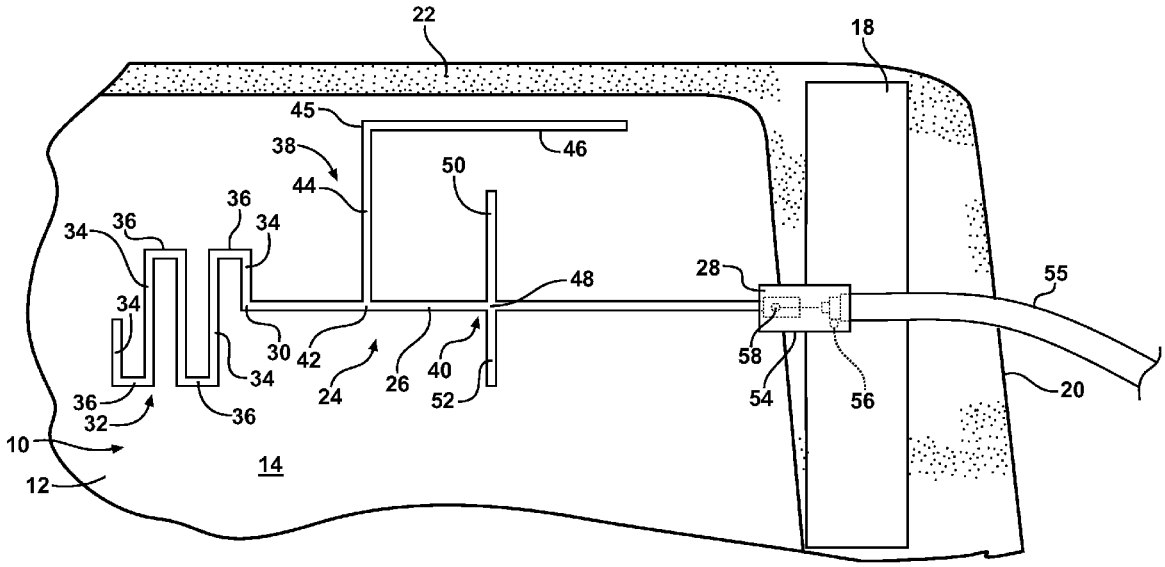
FIG. 1 is a top view of one embodiment of an antenna.
Figure 2:
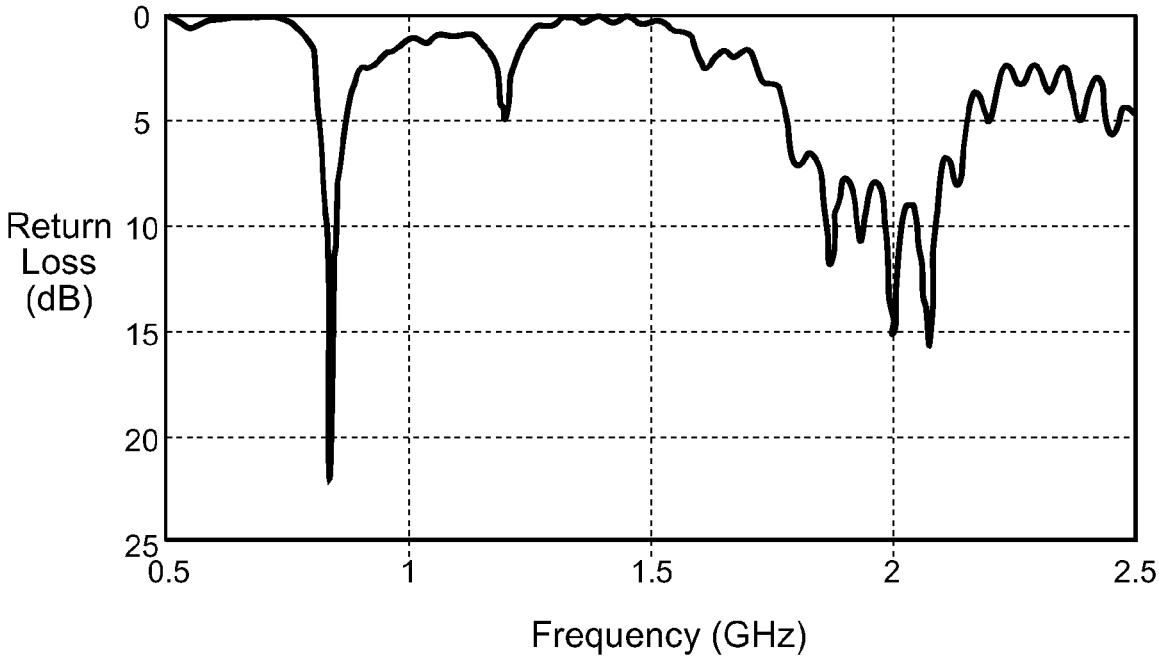
FIG. 2 is a graph showing return loss of the one embodiment of the antenna.
Figure 3:
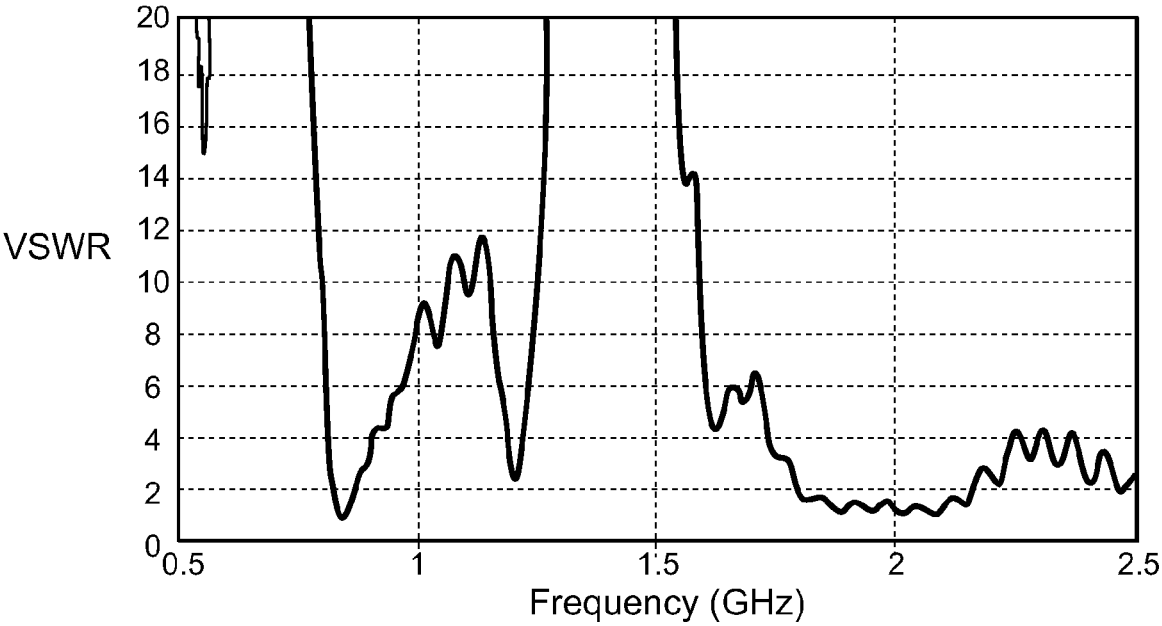
FIG. 3 is a graph showing voltage standing wave ratio of the one embodiment of the antenna.
Figure 4:
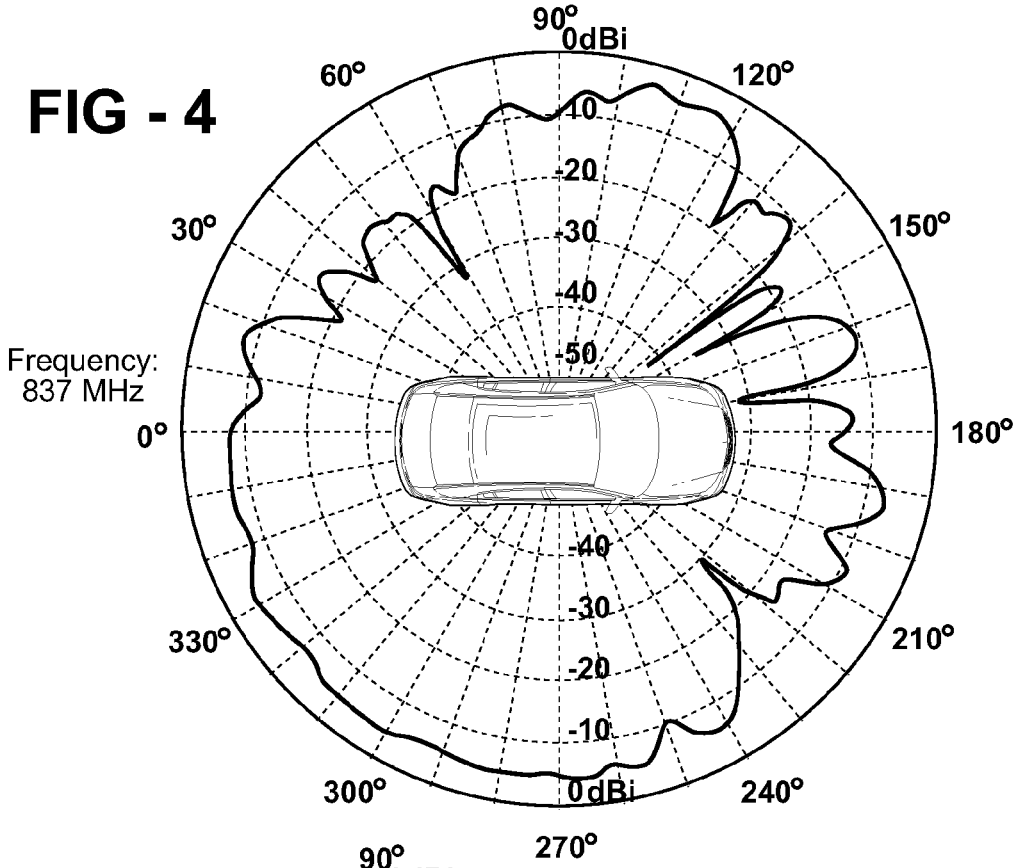
FIG. 4 is a chart showing a radiation pattern of the one embodiment of the antenna at a frequency of 837 MHz.
Figure 5:
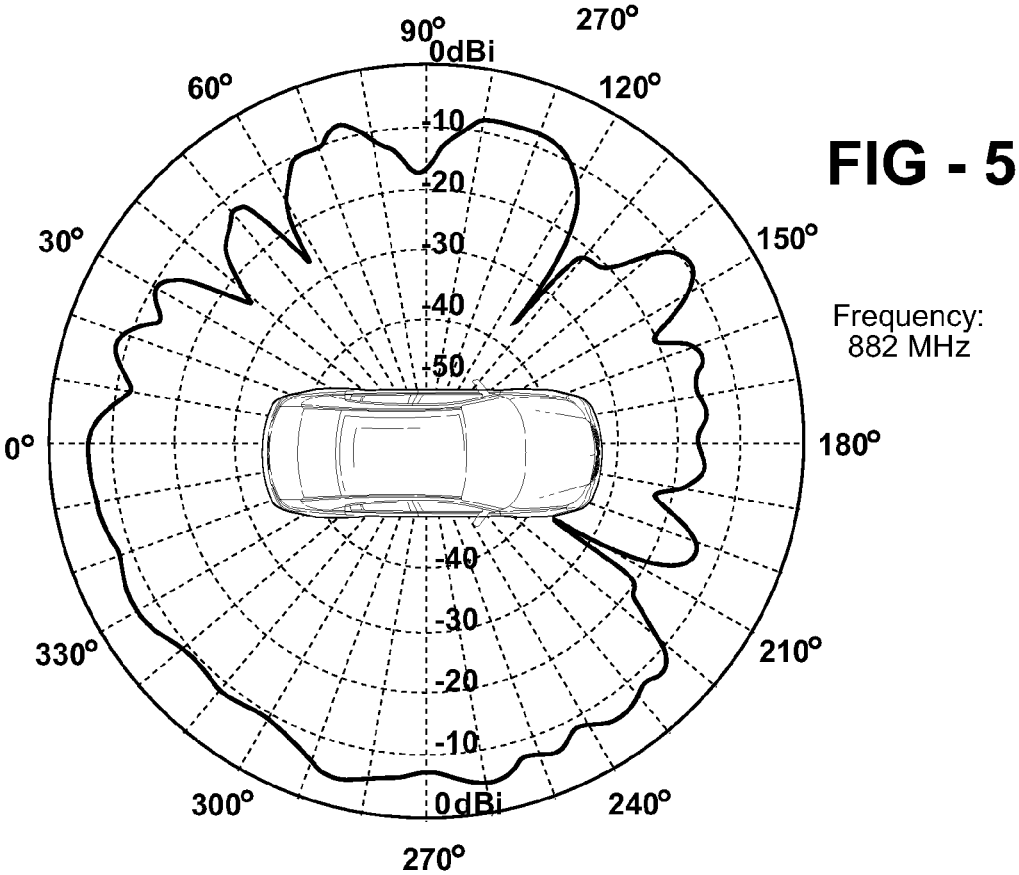
FIG. 5 is a chart showing a radiation pattern of the one embodiment of the antenna at a frequency of 882 MHz.
Figure 6:
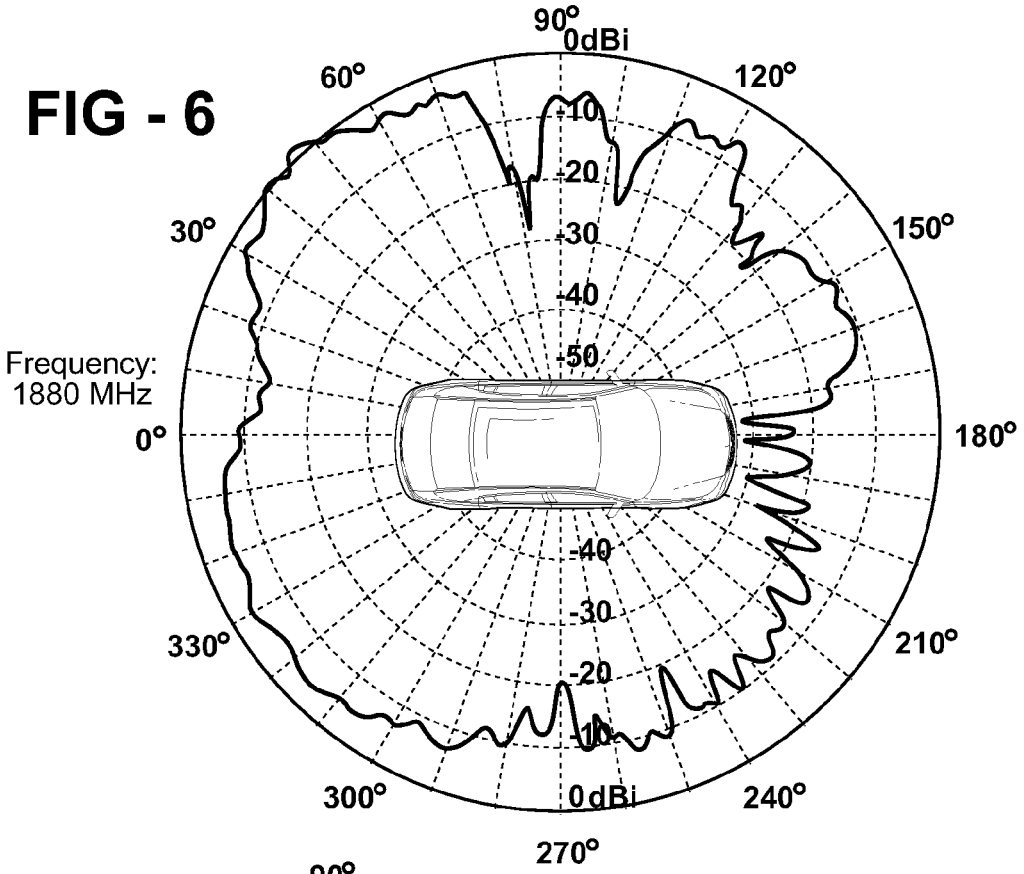
FIG. 6 is a chart showing a radiation pattern of the one embodiment of the antenna at a frequency of 1,880 MHz.
Figure 7:
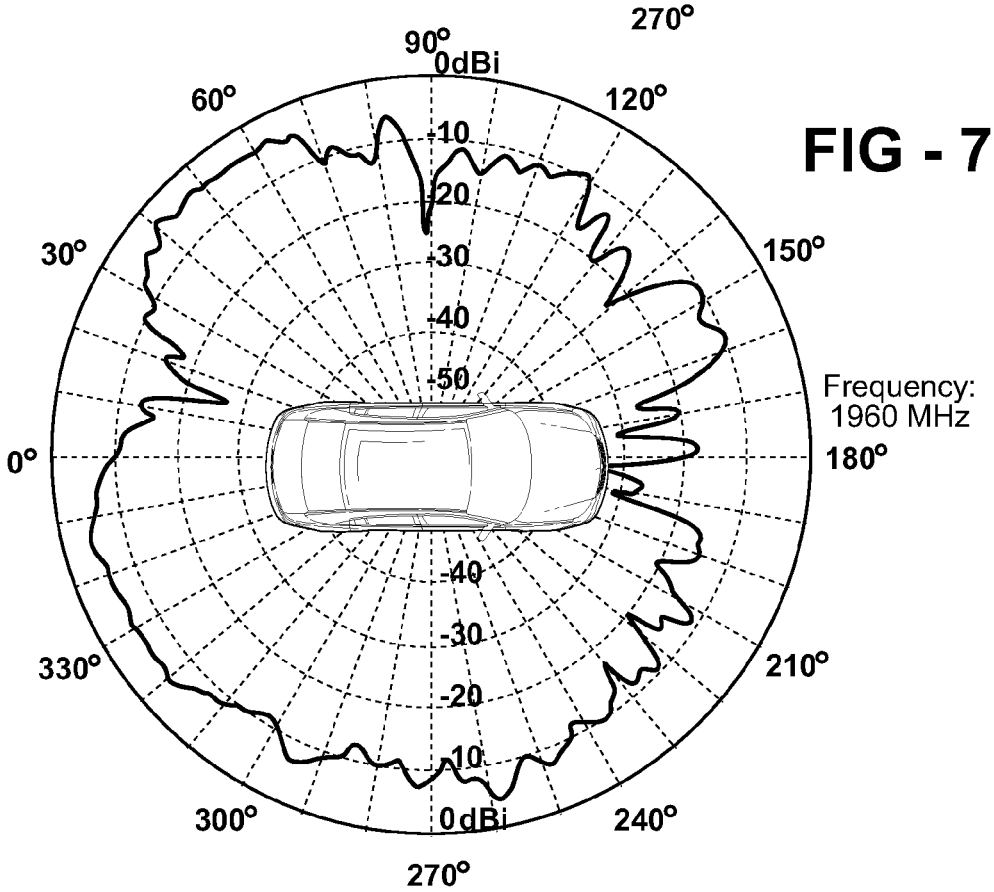
FIG. 7 is a chart showing a radiation pattern of the one embodiment of the antenna at a frequency of 1,960 MHz.
Figure 8:
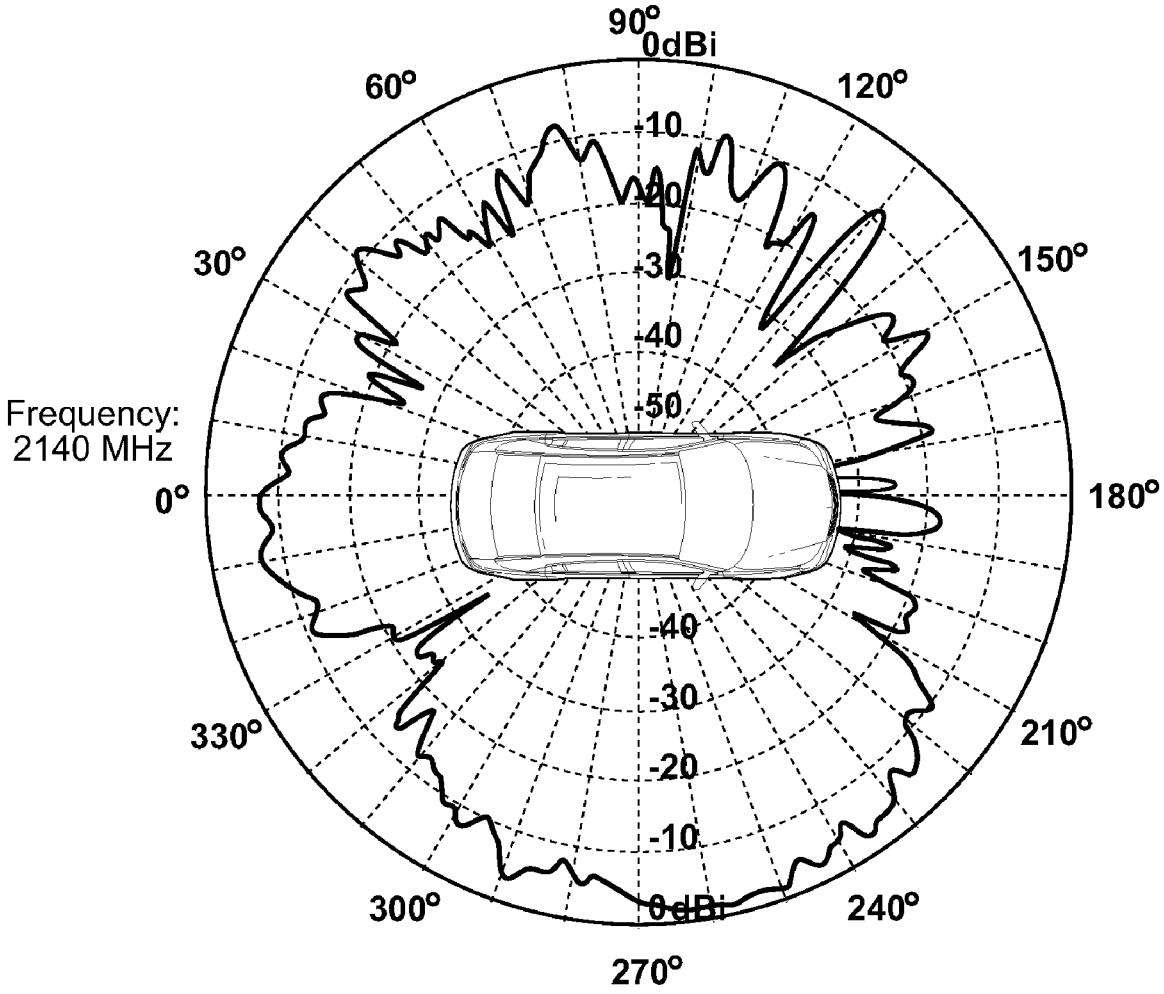
FIG. 8 is a chart showing a radiation pattern of the one embodiment of the antenna at a frequency of 2,140 MHz.

Referring to FIG. 1, the antenna 10 is preferably integrated with a window 12 of a vehicle (not shown). The window 12 is preferably formed of at least one non-conductive pane 14 of transparent material, such as glass. However, other materials may also be suitable for forming the transparent, non-conductive pane 14, such as, but not limited to, a resin. Those skilled in the art realize that transparent materials allow light rays to be transmitted through in at least one direction such that objects on the other side of the transparent material may be seen. The window 12 may alternatively be utilized in non-vehicle applications such as buildings (not shown). The antenna 10 may also be implemented in non-window applications, including, but not limited to, electronic devices such as cellular phones. Of course, those skilled in the art realize other applications for the antenna 10. The antenna 10 is described hereafter as integrated with the window 12, but this should not be perceived as limiting in any way.

As stated above, the antenna 10 operates in multiple frequency bands. Particularly, the illustrated embodiment of the antenna 10 defined herein effectively radiates in a first frequency band, a second frequency band, and a third frequency band. Furthermore, the antenna 10 exhibits an acceptable return loss and voltage standing wave ratio (VSWR) in a range of frequencies defining the first, second, and third frequency bands.

The antenna 10 is suitable for transmitting and receiving linearly polarized RF signals. The antenna 10 is particularly suited for transmitting and receiving vertically polarized RF signals, which are commonly used in cellular/mobile communications networks.

The antenna 10, as described herein, preferably radiates in frequency bands utilized for cellular/mobile communications networks. Specifically, the first frequency band ranges from 824 MHz to 940 MHz, the second frequency band ranges from 1850 MHz to 1990 MHz, and the third frequency band ranges from 1920 MHz to 2170 MHz. Obviously, the second and third frequency bands overlap, such that the antenna 10 of the illustrated embodiment radiates from 824 MHz to 940 MHz and 1850 MHz to 2170 MHz. It is to be understood that these frequency ranges are merely exemplary and other frequency bands are within the scope of the subject disclosure. Also, it is to be understood that any frequency may apply to any of the first, second, or third desired frequency bands. Of course, the dimensions of the antenna 10, as described in further detail below, may be altered to allow operation of the antenna 10 in other frequency bands and/or additional frequency bands.

The antenna 10 includes a ground plane 18 formed of conductive material. In the illustrated embodiment, the ground plane 18 is generally flat and disposed on the non-conductive pane 14. The ground plane 18 generally defines a rectangular shape. Specifically, the ground plane 18 of the illustrated embodiment has a width of 45 mm and a length of 185 mm. However, those skilled in the art realize the ground plane 18 may have different shapes, sizes, and/or configurations.

The non-conductive pane 14 defines a periphery 20, i.e., an edge. Preferably, the ground plane 18 is disposed near the periphery 20 of the non-conductive pane 14 and is grounded by electrical connection to the chassis, i.e., the metallic structure, of the vehicle. In other embodiments (not shown), the ground plane 18 may be disposed off of the non-conductive pane 14. For example, the sheet metal of the vehicle itself may be utilized as the ground plane 18 of the antenna 10.

Windows 12 of vehicles often include a non-transparent coating 22 around the periphery 20 of the window 12. The non-transparent coating 22 may be paint or ceramic frit and is typically black in color. As stated above, and shown in FIG. 1, the ground plane 18 is disposed adjacent the periphery 20 of the window 12. Preferably, the ground plane 18 is at least partially concealed by the non-transparent coating 22. such that the ground plane 18 is not easily viewable on the window 12. Most preferably, the ground plane 18 is completely concealed by the non-transparent coating 22. Thus, the ground plane 18 will not impede the vision of the driver any more than is already impeded by the non-transparent coating 22.

The antenna 10 also includes a radiating strip 24 formed of conductive material. The radiating strip 24 is preferably disposed on the non-conductive pane 14. Accordingly, the radiating strip 24 is generally co-planar with the ground plane 18. That is, a plane (not shown) defined by the radiating strip 24 and a plane (not shown) defined by the ground plane 18 are no more than ten degrees offset from one another.

The term "radiating strip" 24, as used herein, refers to a series of elongated, thin sections of conductive material that are longer than they are wide. In the illustrated embodiment, the radiating strip 24 is implemented with a conductive paint that is fired on the non-conductive pane as is well known to those skilled in the art. In other embodiments, the radiating strip 24 may be a wire that is attached to the non-conductive pane 24 or sandwiched between multiple non-conductive panes 24 as is also well known to those skilled in the art. Furthermore, those skilled in the art will realize other techniques to implement the radiating strip 24.

The radiating strip 24 is electrically isolated from the ground plane 18. Said another way, the electrical resistance between the radiating strip 24 and the ground plane 18 is sufficiently high to prevent normal current flow therebetween. As such, the ground plane 18 provides a reflector for RF signals.

In the illustrated embodiment, the ground plane 18 and the radiating strip 24 is situated on an inside of the vehicle. That is, the ground plane 18 and the radiating strip 24 are situated on the side of the window 12 that faces the passenger compartment of the vehicle. As such, the window 12 and the non-conductive pane 14 functions as a radome for the ground plane 18 and the radiating strip 24 to protect them from moisture and other external elements.

The radiating strip 24 includes an elongated portion 26 has a proximal end 28 and a distal end 30. Said another way, the radiating strip 24 extends from the proximal end 28 to the distal end 30. The proximal end 28 is adjacent to, but not in electrical contact with, the ground plane 18. As such, the elongated portion 26 may be described as extending away from the ground plane 18. In the illustrated embodiment, the elongated portion 26 has a length of about 80 mm.

The radiating strip 24 also includes a meander line portion 32. The meander line portion 32 extends away from the distal end 30 of the elongated portion 26. The meander line portion 32 extends vertically, then horizontally, then vertically, etc, terminating at a distal end 33. Thus, the meander line portion 32 includes vertical components 34 and horizontal components 36. In the illustrated embodiment, the vertical components 34 have a maximum length of about 25 mm while the horizontal components 36 have a length of about 5 mm. The vertical and horizontal components 34, 36 provide meander for two "cycles", i.e., two times "up and down". Thus, since the meander line portion 32 cycles up and down, an overall width of the meander line portion 32 (defined between its distal end 33 and the distal end 30 of the elongated portion 26) measures about 20 mm. Overall, the width of the radiating strip 24 is about 100 mm.

Generally, the meander line portion 32 enables the antenna 10 to operate in lower frequency band ranges. For example, in the illustrated embodiment, the meander line portion 32 is sized to receive signals in the first frequency band. It is to be understood that the lengths of the vertical and horizontal components 34, 36 of the meander line portion 32 may be different than those described or shown in the Figures, and that changing the lengths of the vertical and horizontal components 34, 36 changes the range of the first frequency band. In other words, the lengths may be used to tune the antenna 10. In addition, the lengths in the vertical and horizontal components of the meander line portion 32 can be adjusted to adjust the inductance as well as affect input impedance of the antenna 10.

The radiating strip 24 also includes at least one tuning stub 38, 40 extending from the elongated portion between the proximal end 28 and the distal end 30. In the illustrated embodiment, the radiating strip 24 includes a first tuning stub 38 and a second tuning stub 40.

The first tuning stub 38 extends from a first point 42 on the elongated portion 26. In the illustrated embodiment, the first point 42 is spaced about 60 mm from the proximal end 28 and 20 mm from the distal end 30. The first tuning stub 38 includes a first section 44 extending generally perpendicularly from the first point 42 of the elongated portion 26 to a distal end 45. The first tuning stub 38 also includes a second section 46 extending generally perpendicularly from the first section 46 at the distal end 45. Preferably, the second section 46 extends away from the distal end 45 of the first section 44 and towards the ground plane 18. In the illustrated embodiment, the first section 44 measures about 35 mm and the second section 46 measures about 60 mm.

The second tuning stub 40 extends from a second point 48 on the elongated portion 26. In the illustrated embodiment, the second point 48 is spaced about 40 mm from the proximal end 28 and about 40 mm from the distal end 30. As such, the first point 42 is spaced from the second point 48. The second tuning stub 40 includes a third section 50 extending generally perpendicularly from the elongated portion 26. That is, the third section 50 meets the elongated portion 26 at a right angle. The second tuning stub 40 also includes a fourth section 52 extending generally perpendicularly from the elongated portion in a generally opposite direction from the third section 50. As such, the second tuning stub 40 forms a cross with the elongated portion 26. In the illustrated embodiment, the third section 50 measures about 25 mm and the fourth section 52 measures about 14 mm.

The lengths of the sections 44, 46, 50, 52 of the first and second tuning stubs 38, 40 relate primarily to the ranges of the second and third desired frequency bands. That is, as the length of each section 44, 46, 50, 52 of the first and second tuning stubs 38, 40 changes, the range of the second and third desired frequency bands change as well. In addition, adjusting the first and second tuning stubs 38, 40 changes the return loss characteristics of the antenna 10. Furthermore, the first and second tuning stubs 38, 40 allow the antenna 10 to achieve vertical polarization.

In the illustrated embodiment, the antenna 10 also includes a connector 54. The connector 54 allows connection of a transmission line 55 to the antenna 10. The connector 54 includes a first terminal 56 electrically connected to the ground plane 18 and a second terminal 58 electrically connected to the radiating strip 24. In the illustrated embodiment, the connector 54 is disposed partially atop the ground plane 18. Furthermore, in the illustrated embodiment, the connector 54 is disposed along one of the 185 mm sides of the ground plane 18 and extends off of that side by a distance of about 13 mm. A top side (not numbered) of the connector 54 is disposed about 75 mm from a top side (not numbered) of the ground plane 18. However, it is to be appreciated that the transmission line 55 could be connected directly to the radiating strip 24 and the ground plane 18, without the connector 54.

As can be seen in FIGS. 2-8, the antenna 10 of the illustrated embodiment, which includes the meander line portion 32 and tuning stubs 38, 40 described above, produces excellent performance characteristics. In the first, second, and third frequency bands, the antenna 10 produces a return loss of over 10 dB with a voltage standing wave ratio (VSWR) approaching of around or under 2:1.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A multi-band antenna comprising:

a ground plane formed of conductive material;

a radiating strip formed of conductive material and disposed generally co-planar with said ground plane;

said radiating strip including an elongated portion having a proximal end adjacent said ground plane and a distal end terminating in a meander line portion opposite said proximal end of said elongated portion;

a first tuning stub extending from a first point on said elongated portion between said proximal end and said distal end; and a second tuning stub extending from a second point on said elongated portion between said proximal end and said distal end.

2. An antenna as set forth in claim 1 wherein said first tuning stub includes a first section extending generally perpendicularly from said elongated portion at said first point to a distal end.

3. An antenna as set forth in claim 2 wherein said first tuning stub includes a second section extending generally perpendicularly from said distal end of said first section.

4. An antenna as set forth in claim 3 wherein said second section extends towards said ground plane.

5. An antenna as set forth in claim 3 wherein said second tuning stub includes a third section extending generally perpendicularly from said elongated portion.

6. An antenna as set forth in claim 5 wherein said second tuning stub includes a fourth section extending generally perpendicularly from said elongated portion opposite from said third section.

7. An antenna as set forth in claim 1 wherein said first point is spaced from said second point.

8. An antenna as set forth in claim 1 further comprising a connector for connecting a transmission line to said antenna and having a first terminal electrically connected to said ground plane and a second terminal electrically connected to said radiating strip.

9. A window for a vehicle having an integrated multi-band antenna, said window comprising:

a non-conductive pane formed of a transparent material;

a ground plane formed of conductive material and disposed on said non-conductive pane;

a radiating strip formed of conductive material and disposed on said non-conductive pane such that said radiating strip is generally co-planar with said ground plane;

said radiating strip including an elongated portion having a proximal end adjacent said ground plane and a distal end terminating in a meander line portion opposite said proximal end of said elongated portion;

a first tuning stub extending from a first point on said elongated portion between said proximal end and said distal end; and a second tuning stub extending from a second point on said elongated portion between said proximal end and said distal end.

10. A window as set forth in claim 9 wherein said non-conductive pane includes a periphery and said non-conductive pane includes a non-transparent coating disposed adjacent to said periphery.

11. A window as set forth in claim 10 wherein said ground plane is disposed adjacent said periphery of the non-conductive region and is at least partially concealed by said non-transparent coating.

12. A multi-band antenna comprising:

a ground plane formed of conductive material;

a radiating strip formed of conductive material and disposed generally co-planar with said ground plane;

said radiating strip including an elongated portion having a proximal end adjacent said ground plane and a distal end terminating in a meander line portion opposite said proximal end of said elongated portion;

a first tuning stub extending from a first point on said elongated portion between said proximal end and said distal end;

a second tuning stub extending from a second point on said elongated portion between said proximal end and said distal end;

wherein said first tuning stub includes a first section extending generally perpendicularly from said first point of said elongated portion to a distal end and a second section extending generally perpendicularly from said distal end of said first section; and wherein said second tuning stub includes a third section extending generally perpendicularly from said elongated portion and a fourth section extending generally perpendicularly from said elongated portion in a generally opposite direction from said third section.

13. An antenna as set forth in claim 12 wherein said first point is spaced from said second point.

14. An antenna as set forth in claim 12 wherein said second section extends towards said ground plane.

* * * * *